United States Patent [19]

Fastert et al.

[11] Patent Number: 4,566,526

[45] Date of Patent: Jan. 28, 1986

[54] METHOD AND APPARATUS FOR SEMI-HORIZONTAL CONTINUOUS CASTING

[75] Inventors: Herbert Fastert, Wyckoff, N.J.; Carl Langner, Monsey, N.Y.

[73] Assignee: Concast, Incorporated, Montvale, N.J.

[21] Appl. No.: 425,119

[22] Filed: Sep. 27, 1982

[51] Int. Cl.[4] ..... B22D 11/04

[52] U.S. Cl. ..... 164/478; 164/490; 164/420; 164/416; 164/440

[58] Field of Search ..... 164/416, 420, 440, 490, 164/478, 488

[56] References Cited

U.S. PATENT DOCUMENTS

| | | | |
|---|---|---|---|
| 3,367,399 | 2/1968 | Easton | 164/442 |
| 3,472,309 | 10/1969 | Calderon | 164/440 |
| 3,709,285 | 1/1973 | Ruckstuhl | 164/440 |

FOREIGN PATENT DOCUMENTS

| | | | |
|---|---|---|---|
| 0036777 | 9/1981 | European Pat. Off. . | |
| WO81/02990 | 10/1981 | PCT Int'l Appl. . | |
| 0899249 | 1/1982 | U.S.S.R. | 164/440 |

*Primary Examiner*—Kuang Y. Lin
*Assistant Examiner*—Kurt Rowan
*Attorney, Agent, or Firm*—Werner W. Kleeman

[57] ABSTRACT

A method and apparatus for semi-horizontal continuous casting is disclosed employing an essentially horizontally extending continuous casting mold provided at its upper side or top wall with a mold inlet opening for the infeed of the metal to be cast, especially steel. At least one strand guide arrangement serves to guide at least one continuously cast strand which is fed laterally out of the continuous casting mold. The strand guide arrangement for each stand possesses two strand guide tracks or paths curved in opposite direction, the center of curvature of the first curved guide track or path, viewed in the direction of travel of the cast strand, being located below its related path of travel, and the center of curvature of the second curved guide track or path being located above its related path of travel.

18 Claims, 6 Drawing Figures

METHOD AND APPARATUS FOR SEMI-HORIZONTAL CONTINUOUS CASTING

BACKGROUND OF THE INVENTION

The present invention relates to a new and improved method of, and apparatus for, semi-horizontal continuous casting of metals, especially although not exclusively, steels and steel alloys.

From U.S. Pat. No. 3,472,309, granted Oct. 14, 1969 it is known to teem steel into a vertical refractory part of an oscillating mold having the shape of an inverted T, and to withdraw from two horizontal mold parts, merging with the vertical mold part, two partially solidified strands in opposite essentially horizontal directions. Apart from other drawbacks, such as for instance poor visual access into the interior of the casting mold, the large masses which must be oscillated, the sealing problems arising between the individual mold parts and so forth, with this state-of-the-art construction of continuous casting mold large quantities of metal flow out from the not yet solidified strands in the event of metal break-out. Since the continuously cast strands are horizontally conveyed out of the continuous casting mold at the height of the casting mold the cast steel can not only flow out of the continuous casting mold but also from the strand section located after the metal break-out location in the direction of travel of the continuously cast strand.

According to a further known construction of continuous casting mold as disclosed in Russian Pat. No. 578,155, dated Jan. 13, 1978, the metal to be cast is introduced from above into a hollow mold compartment or cavity of the continuous casting mold through an infeed or inlet opening provided at an upper wall of such continuous casting mold. The mold construction consists of a linear mold portion and a curved mold portion. With this mold design it is intended to achieve the result that there is formed an intentional rupture or fracture location at the transition of the linear mold portion into the curved mold portion, since at that location there is supposed to be situated the weakest, hottest and thinnest location of the strand shell or skin. With this prior art continuous casting arrangement continuously cast strands efflux out of the inclined straight mold portion and the likewise inclined curved mold portion, the longitudinal axes of which form an angle with respect to the horizontal. One of the appreciable drawbacks of this prior art mold construction is that the continuous casting mold cannot be oscillated, since the strand shell formed in any one of the mold portions cannot be displaced into the other mold portion. Consequently, between the mold and the formed strand there prevails much too great friction which is caused by the strand withdrawal operation, and there increasingly occur metal break-outs. This undesirable effect is further intensified by virtue of the fact that the strand must be continuously forcefully separated, even if this is accomplished at a fixed rupture or fracture location.

SUMMARY OF THE INVENTION

Therefore, with the foregoing in mind it is a primary object of the present invention to provide a new and improved method and apparatus for semi-horizontal continuous casting which is not associated with the aforementioned drawbacks and limitations of the prior art.

Another important object of the present invention is directed to a new and improved method of, and apparatus for, the semi-horizontal continuous casting of strands, wherein the above drawbacks do not arise, and with as low as possible or extremely low structural height of the continuous casting apparatus there is nonetheless provided the ferrostatic or metallostatic pressure needed for producing a faultless cast product.

Still a further significant object of the present invention is directed to a new and improved method of, and apparatus for, continuously casting strands wherein, upon the occurrence of metal break-out at the partially solidified strand, there is ensured that no or only as little as possible molten metal will run out of the already cast strands.

A further important object of the present invention is directed to a new and improved construction of continuous casting apparatus and method of operating the same, especially for the semi-horizontal continuous casting of strands, wherein the continuous casting operation can be accomplished in an economical, reliable and efficient manner, and nonetheless in the event metal break-out occurs the amount of molten metal flowing out of the ruptured strand can be minimized.

Now in order to implement these and still further objects of the invention, which will become more readily apparent as the description proceeds, the inventive method for continuously casting metal strands contemplates introducing the molten metal, particularly steel, into a metallic essentially horizontally extending continuous casting mold through an inlet opening provided at its upper mold wall. There is withdrawn from at least one lateral outlet opening of the continuous casting mold a partially solidified continuously cast strand and such strand is guided and further cooled. According to the invention, the strand is guided along strand guide tracks or paths which are curved in two opposite directions and to a lower level than the level of the continuous casting mold, and thereafter the withdrawn strand is straightened.

As already alluded to above, the invention is not only concerned with the aforementioned method aspects but also relates to an improved construction of continuous casting apparatus or installation which is of the type containing an essentially horizontally extending continuous casting mold which is provided at its upper side or top wall with a mold inlet or infeed opening for the infeed of the metal which is to be cast, especially steel. Further, there is provided at least one strand guide arrangement for guiding at least one strand which departs laterally out of the continuous casting mold. According to the invention the strand guide arrangement for each cast strand possesses two strand guide tracks or paths which are curved in opposite directions. The center of curvature of the first downwardly curved rack, viewed in the strand direction of travel, is located below its related strand guide track or path, and the center of curvature of the second upwardly curved guide track is located above its related strand guide track or path.

As used in the specification and claims herein, the terminology "downwardly curved" and "upwardly curved" in reference to the guide tracks or paths refers to the positional relationship of the center of curvature of the guide track to the guide path of the strand. Thus, the center of curvature of a "downwardly curved" guide track is below the guide path and the center of curvature of an "upwardly curved" guide track is above the guide path.

The employed oscillating continuous casting mold can possess either a straight or curved hollow mold compartment or cavity and the molten metal can be introduced from above into the hollow mold compartment, with or without the use of a pouring tube, typically an immersible refractory pouring tube.

By guiding the cast strand to a lower level than the level of the continuous casting mold by means of two strand guide tracks or paths which are curved in opposite drection there is achieved the beneficial result that no metal or no appreciable amount of metal can flow out of the strand section located after the metal breakout location, viewed in the direction of travel of the strand. If the cast strand should be outfed essentially horizontally then the second curved strand guide track affords a protective pre-bending of the strand shell or skin. Additionally, by virtue of the obtained elevational difference to the continuous casting mold there is produced an increased ferrostatic or metallostatic pressure in relation to purely horizontal casting installations, and such increased ferrostatic or metallostatic pressure might enhance the quality of the casting product. Furthermore, the elevational difference allows infeeding of hot metal by using conventional methods, and while maintaining a visible and controllable meniscus.

The metal, especially steel, can be conveyed out of one lateral outlet or discharge opening of the continuous casting mold. However, to increase the casting productivity it is advantageous to outfeed continuously cast strands from both lateral oppositely situated outlet or discharge openings of the continuous casting mold.

So as to not to exert any excessive load upon the strand shell or skin it is possible, according to a further aspect of the invention, for the strand laterally departing from the continuous casting mold containing a linear hollow mold compartment, to first pass through a short linear guide track or path before it is downwardly curved.

If necessary, there can be provided for metallurgical reasons a linear guide track or path which merges with the first curved strand guide arrangement.

The partially solidified strand, during the time that it is guided by the related strand guide arrangement, can be impinged by means of suitable cooling devices, after its departure out of the continuous casting mold, with a suitable coolant, such as typically water or an air-water mixture and further cooled. Consequently, the thickness of the solidified strand shell or skin increases. Since the strand can be more intensively curved as the strand shell thickness increases, it is advantageous, for instance for reducing the structural height of the continuous casting apparatus or installation, to guide the strand along two curved strand guide tracks or paths having different radius of curvature. For the same reason it can be beneficial to provide at least one of these guide tracks with a number of different radii of curvature, in order to guide or bend, as the case may be, the strand, for instance, in the first curved guide track possessing decreasing radii of curvature. In the subsequently arranged second curved strand track or path the radius of curvature can further increase until the strand is straightened by a suitable straightening machine or unit so as to have a straight or linear shape with an infinite radius of curvature, and such strand is then withdrawn horizontally or with its lengthwise strand axis inclined to the horizontal.

Particularly in those instances when the strands need not be horizontally outfed it can be sufficient to use a downwardly curved guide portion or section in order to obtain the desired effect.

According to the invention there can be cast strands of the most different formats or sectional shapes. It can be advantageous to simultaneously cast two different formats at the same continuous casting apparatus or installation, for instance at the right side of the casting installation to cast a slab having a rectangular cross-section and at the left side of the installation two blooms having a quadratic or square cross-sectional configuration, in which case then there can be used different radii of curvature. Thus, for instance, the blooms pass through a first curved guide track having a first radius of curvature and a second guide track having a second radius of curvature, wherein the first radius of curvature is greater than the second radius of curvature, and the slab is progressively guided along a curve in the first guide track having a first radius of curvature and then in the second curved guide track having the larger radii of curvature.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
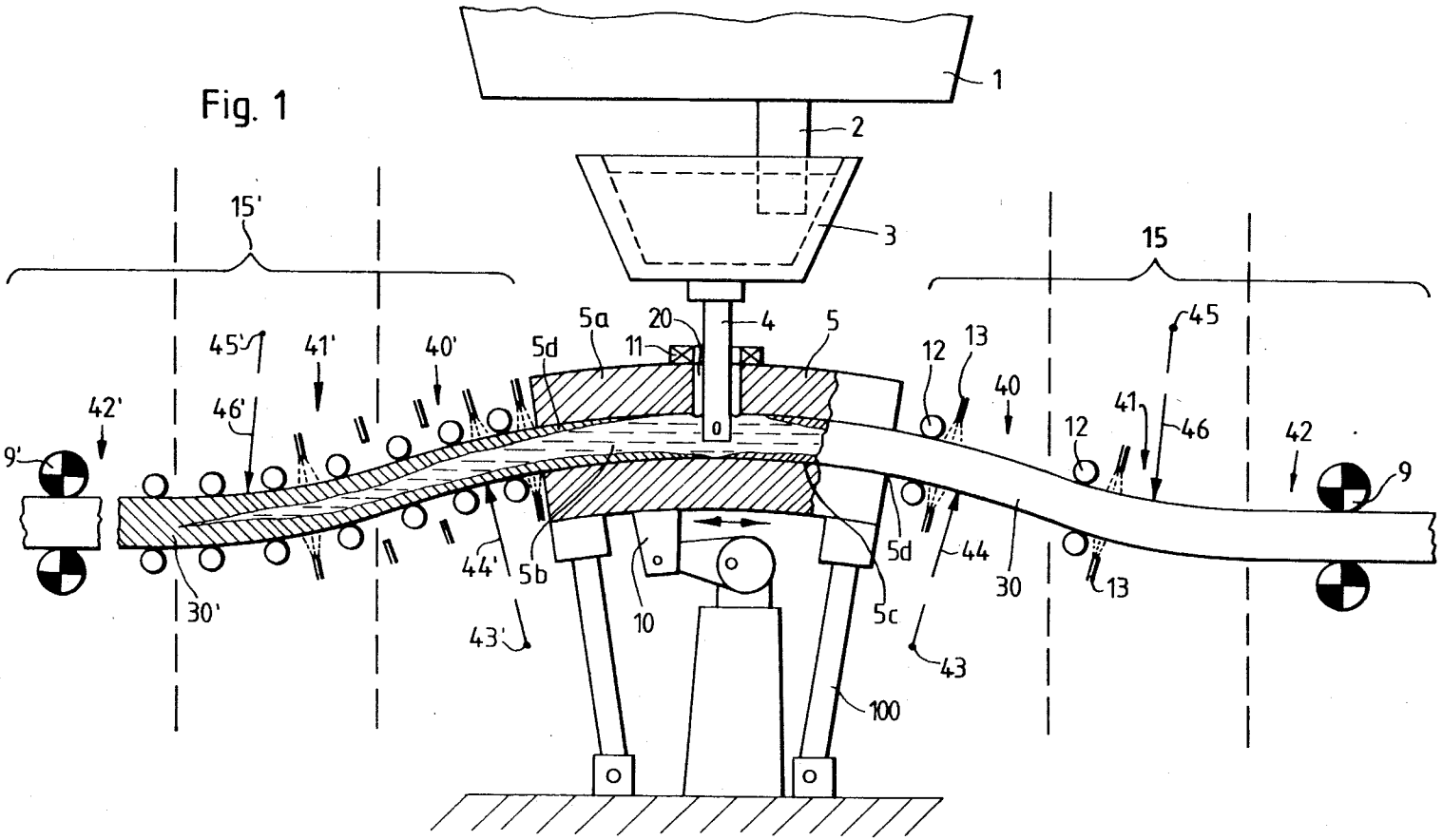
FIG. 1 is a schematic elevational view, partially in section, of a continuous casting apparatus or installation constructed according to the invention.

Describing now the drawings, it is to be understood that only enough of the construction of the continuous casting apparatus or installation has been shown as needed for those skilled in this art to readily understand the underlying principles and concepts of the present development, while simplifying the illustration of the drawings. Turning attention specifically now to FIG. 1, there is depicted an exemplary embodiment of continuous casting apparatus or installation wherein molten metal, in particular although not exclusively steel, is teemed from a casting ladle 1 by means of a ladle pouring tube 2 into a tundish 3 and from that location is cast by means of, for instance, an immersible refractory pouring tube 4 into a water-cooled, metallic double-ended continuous casting mold 5. The metal inflow can be regulated by any suitable flow regulation devices known as such in the continuous casting art, for instance such metal inflow can be controlled by suitable stoppers and/or slides.

The pouring tube 4 extends through mold infeed or inlet opening 20 provided at an upper mold wall **5*a* of the continuous casting mold 5 and immerses below the molten bath level or meniscus in such continuous casting mold 5. The immersible pouring tube 4 distributes the hot molten metal, here steel, into the hollow mold compartment or cavity 5*b*** of the continuous casting mold 5 such that there can not form at the direct metal inflow region any strand shell or skin along the mold walls, generally indicated by reference character 5c, bounding such hollow mold compartment 5b. Hence, there is ensured that the continuously cast strands 30 and 30' formed in the continuous casting mold 5 can be bidirectionally withdrawn independently of one another at both opposite lateral ends or sides of the continuous casting mold 5. In the embodiment under discussion this continuous casting mold 5 possesses a curved hollow mold compartment 5b and is oscillated along a circular arc or curve by means of any suitable mold oscillation drive, generally indicated by reference numeral 10, for instance a standard eccentric drive arrangement. Other mold oscillation devices known in this art can be likewise beneficially used. To allow such mold oscillation the continuous casting mold 5 is here shown supported upon pivotal guide levers or links 100.

After the departure of the continuously cast strands 30 and 30' out of the two oppositely situated lateral outlet or discharge openings 5d of the oscillating continuous casting mold 5 these cast strands 30 and 30' are guided through their related strand guide arrangement 15 and 15', each of which defines or consists of a number of adjacently arranged guide tracks or paths 40, 41, 42 and 40', 41' and 42', respectively, the range of which has been conveniently schematically indicated in the showing of FIG. 1 by the vertically extending broken lines which are spaced from one another. In the construction of FIG. 1 both of the strand guide arrangements 15 and 15' are symmetrically disposed with respect to one another. Immediately after its departure out of the continuous casting mold 5 the strand 30 is guided along the curved guide path or track 40, wherein the center 43 of its radius of curvature 44 is located below such curved guide track or path 40. The radius of curvature 44 thus corresponds essentially to the radius of the arc along which the continuous casting mold 5 is oscillated. Merging with this first curved guide track or path 40 is the second curved guide track or path 41, wherein the center 45 of its radius of curvature 46 is arranged above the related guide track or path 41 and such radius of curvature 46 essentially corresponds to the radius of curvature 44 of the first curved guide track or path 40. Along such curved guide tracks or paths 40 and 41 the strand 30 is guided by means of the rolls or rollers 12 and such strand is further cooled by the related spray nozzles 13 or equivalent structure.

Importantly, it will be recognized that if metal break-out should occur at such semi-horizontal continuous casting installation, then no appreciable quantity of molten metal can flow out of the strand section or portion located, in the direction of travel of such strand, after the metal break-out location.

Both of the continuously cast strands 30 and 30' are withdrawn from the opposed outlet or discharge ends 5d of the continuous casting mold 5 by the action of suitably driven strand withdrawal or pinch rolls 9 and 9', respectively. Since both of the cast strands 30 and 30' are not connected with one another by any interconnecting strand shell or skin, the withdrawal speeds of both of the cast strands 30 and 30' can advantageously differ from one another if desired.

Merging with both of the curved strand guide tracks or paths 40 and 41 is a substantially linear horizontal guide track or section 42 which contains the aforementioned driven strand withdrawal or pinch rolls 9.

It will be apparent from the illustration of FIG. 1 that at the opposite side or end of the double-ended continuous casting mold, in other words at the mold side or end where there is formed the other strand 30' the linear horizontal strand guide section or track 42' merges with both of the curved guide tracks or paths 40' and 41' and likewise contains the related driven strand withdrawal or pinch rolls 9'.

Figure 2:
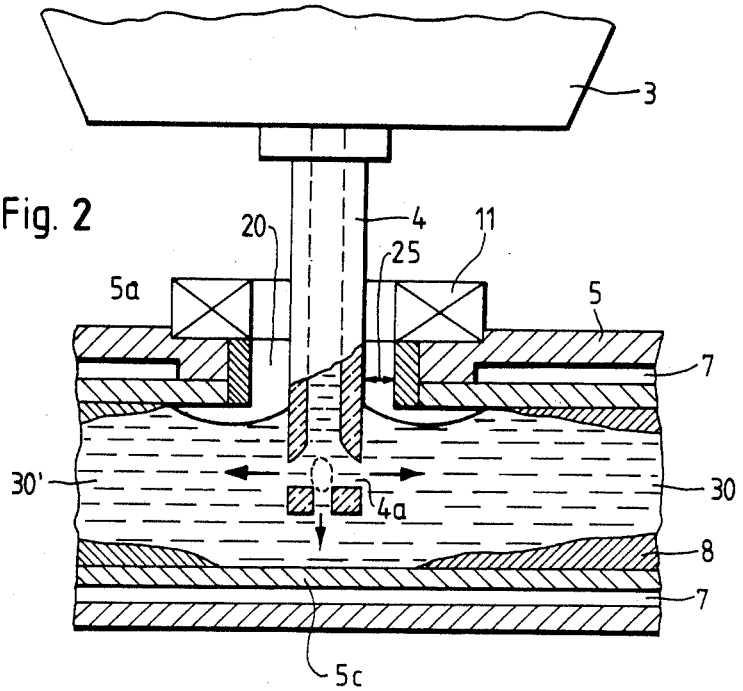
FIG. 2 is an enlarged detail showing of the continuous casting mold of the casting installation of FIG. 1, depicting the infeed of the molten metal, typically steel, into the continuous casting mold.

Turning attention now to FIG. 2, there have been illustrated therein details of the double-ended continuous casting mold 5, particularly the region of infeed of the molten metal into the mold 5 at the mold infeed or inlet opening 20. In particular, there will be seen the immersible pouring tube 4 which extends through the mold inlet or infeed opening 20 provided at the upper side or top wall 5a of the oscillating continuous casting mold 5. This pouring tube 4 extends through the mold inlet opening 20 such that between the outer surface of such pouring tube 4 and the inner bounding wall of such mold inlet opening 20 there exists a spacing 25. This spacing 25 must be greater than the oscillation stroke of the continuous casting mold 5 which is imparted thereto by the mold oscillation drive or mechanism 10, in order to ensure that the immersible pouring tube 4 is not damaged during mold oscillation. Furthermore, the continuous casting mold 5 is here assumed to be a water-cooled mold, and for that purpose this mold 5 is constructed such that the cooling water can flow through suitable cooling slots or chambers 7 provided in the mold walls of the continuous casting mold 5. Extending about the immersible pouring tube 4 is an electromagnetic coil 11 which is arranged at the upper or top wall 5a of the continuous casting mold 5 above the region of the mold inlet opening 20. This electromagnetic coil 11 generates an electromagnetic field which exerts a force which downwardly presses upon the liquid meniscus or molten bath level within the continuous casting mold 5. In this way there is avoided that the molten metal will tend to crystallize about the mold inlet opening 20 and give cause for a metal break-out. Additionally, the electromagnetic field generated by the electromagnetic coil 11 prevents any escape of the molten steel through the mold inlet opening 20 due to the prevailing ferrostatic or metallostatic pressure. The immersible pouring tube 4 is provided with suitable outlet or discharge openings, generally indicated by reference numeral 4a, by means of which the hot steel is directly deflected towards the mold walls 5c, in order to prevent the formation of a continuous interconnecting strand shell or skin along the mold walls at the region of the interface between the two cast strands 30 and 30'.

Continuing, FIGS. 3, 4, 5 and 6 respectively depict different possibilities as concerns the manner in which the strand guide arrangements can extend in accordance with the teachings of the present invention for one or a number of cast strands or castings. The selection of the relevant track shape is perfected in accordance with the encountered requirments, for instance the size of the strand format which is to be cast, the grades to be cast, the weight of the charge which is to be teemed, the available space and so forth.

To simplify the illustration of the drawings in FIGS. 3 to 6 there have only been depicted with broken lines the center line of the related strand track or path, and thus, indicate the travel path assumed by a cast strand departing from the horizontally extending continuous casting mold 5 which may possess either a linear or curved hollow mold compartment. The guide tracks or paths themselves are formed by conventional and therefore not here particularly further illustrated guide rolls or guide rails containing the appropriate devices for the secondary cooling of the related cast strand. To also simplify the illustration each continuous casting mold of the various casting arrangements depicted in FIGS. 3, 4 and 5 has been shown to have operatively correlated therewith, at the left and right sides of each such continuous casting mold 5, two different strand guide arrangements. Of course, it should be quite evident that normally each of the continuous casting molds 5 will be provided at both opposed mold sides with essentially identical strand guide arrangements. However, if there is to be produced at one side or end of the double-ended continuous casting mold, for instance, a partially solidified strand having a slab sectional shape or format, and at the other opposite side or end of the mold one or a number of partially solidified strands having a bloom format or sectional shape, then it is possible to appropriately arrange the strand guide arrangements as to their course of travel or extent and their construction to the left and right of the continuous casting mold 5 so as to be different from one another. Also, to simplify the illustration of the drawings and as a matter of clarity in the representation thereof, the individual strand guide sections or regions have been separated from one another by the broken essentially vertically extending lines.

Figure 3:
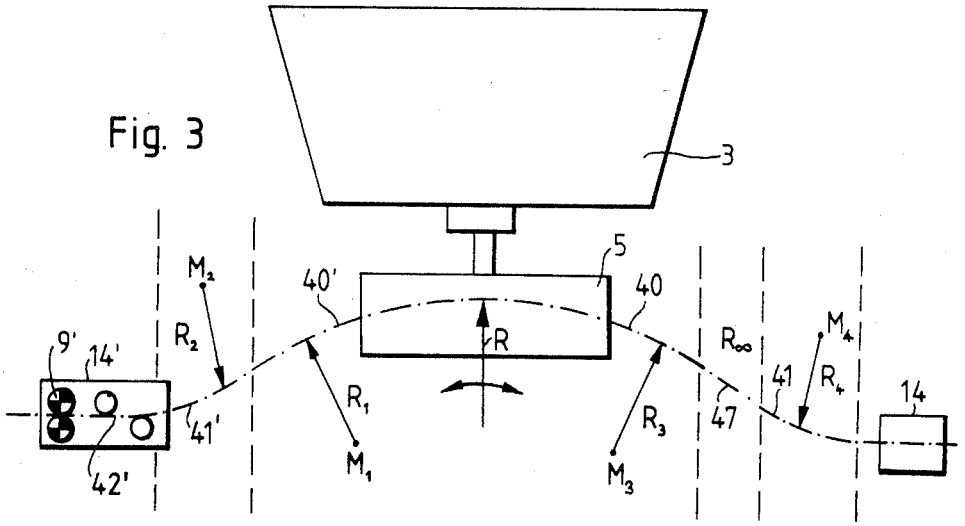
FIGS. 3, 4, 5 and 6 respectively schematically depict different possibilities of designing the strand guide tracks or paths for the continuously cast strands.

Turning attention now specifically to FIG. 3, there is teemed from above molten steel which is supplied by a suitable casting vessel 3, for instance a tundish, into a horizontally arranged, cooled, copper continuous casting mold 5 which oscillates in the direction of the depicted double-headed arrow along a circular arc or arcuate path of travel having the radius R. According to the illustration appearing at the left side of the double-ended continuous casting mold 5 the strand is guided along a first downwardly curved guide track or path 40' having the radius of curvature R1, and a center M1 of such radius of curvature R1 is located below the corresponding strand track or path 40'. Directly thereafter the continuously cast strand passes through an oppositely curved guide track or path 41' having the radius of curvature R2 and the radius of curvature center M2. This center M2 of the radius of curvature R2 is located above the related oppositely curved guide track or path 41'. Thereafter the continuously cast strand is withdrawn by a suitable strand straightening and withdrawal machine or unit 14' which contains the driven strand withdrawal rolls 9' and is guided along a substantially horizontal guide track or path 42'. With the aid of this straightening and withdrawal machine 14' it is possible, prior to the start of the casting operation, to also infeed along the strand guide track a suitable dummy or starter bar into the mold 5 and which is needed for the incipient closing of the mold outlet openings at opposed ends of the continuous casting mold 5. The radii of curvature R1 and R2 of both of the oppositely curved guide tracks or paths 40' and 41' are here of the same magnitude. This results in a number of advantages, for instance as concerns the exchangeability of the components of the strand guide arrangement, maintenance and so forth.

As will be seen by now referring to the right-hand side of the arrangement of FIG. 3, there is provided between both of the oppositely curved guide tracks or paths 40 and 41 containing the radii of curvature R3 and R4, respectively, a straight guide path or section 47 having the radius of curvature which is at infinity. With this strand guide arrangement which is intended to guide and support a larger size strand format or sectional shape, there is built-up within the cast strand a higher ferrostatic or metallostatic pressure.

Figure 4:
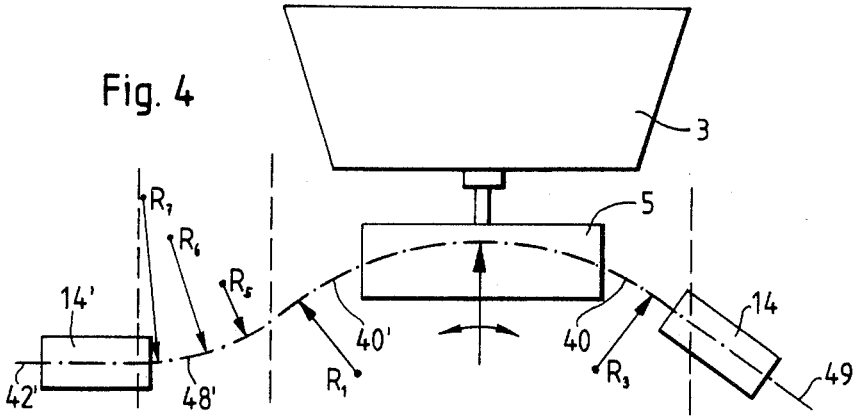

Continuing, and turning attention now to the modified arrangement of continuous casting apparatus or installation depicted in FIG. 4 there will be seen that there is provided at the left-hand side of the continuous casting mold 5 having a curved hollow mold compartment and oscillating along a circular arc an essentially arcuate or circular arcuate-shaped strand guide track or path 40' having the radius of curvature R1. Prior to straightening and horizontally outfeeding the cast strand at the strand guide section 42' the cast strand, however, is guided after the curved guide track or path 40' along a guide track or path 48' which possesses a number of mutually different radii of curvature R5, R6 and R7 which may progressively increase. With this somewhat more complicated solution it is possible to guide as protectively as possible the strand in accordance with the progress of the solidification of the strand shell or skin. As illustrated at the right-hand portion of the showing of FIG. 4, the strand, after passing through the downwardly curved guide track or path 40 having the radius of curvature R3, passes through a linear guide track or path 49 which is inclined with respect to the horizontal and where the strand is straightened and outwardly transported.

Figure 5:
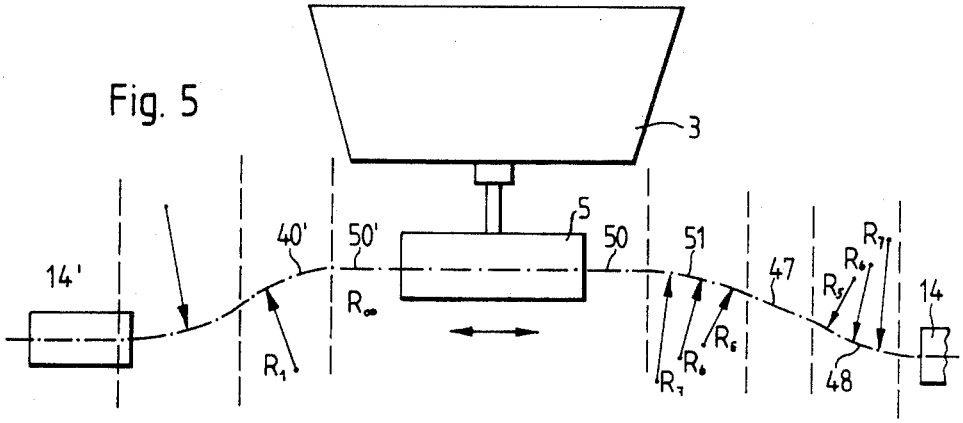

In the caster arrangement of FIG. 5 it is possible to guide the strand from both opposed ends of the double-ended horizontally oscillating continuous casting mold 5 having a straight hollow mold compartment initially along a corresponding substantially horizontal strand guide track 50 and 50' having a related radius of curvature which is infinite. Thereafter, there follows at one side of the mold either a first curved strand track or path 40' having a radius of curvature R1, or at the other side of the mold a guide track or path 51 having different radii of curvature R5, R6 and R7 which may progressively decrease. Thereafter there merges a linearly extending strand track section 47 which transforms into a further curved track portion or section 48 which again possesses a number of mutually different radii R5, R6 and R7 which may progressively increase, followed by a horizontal section or portion 42 of the strand guide arrangement where there is arranged the withdrawal and straightening machine 14.

Figure 6:
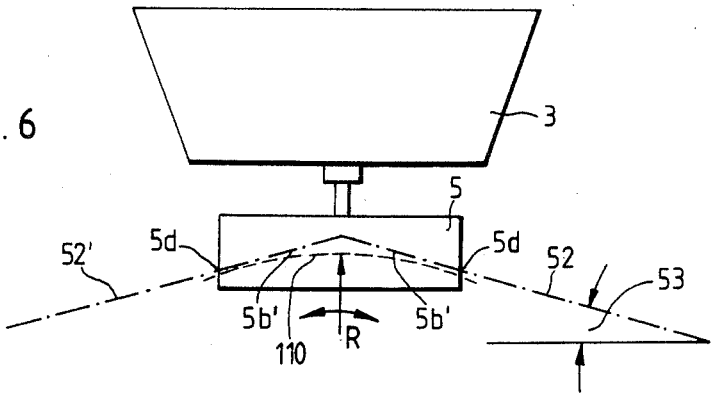

Finally, in the arrangement of FIG. 6 the double-ended continuous casting mold 5 will be seen to possess straight hollow mold compartments or cavities, generally indicated by reference character **5*b'*, which are inclined with respect to one another and also with respect to a horizontal plane. In accordance with the inclination of such hollow mold compartments 5*b'* the subsequently arranged strand guide arrangements 52 and 52' continue at both sides of the continuous casting mold 5, these strand guide arrangements 52 and 52' enclosing an angle 53 with respect to the horizontal. The continuous casting mold 5 is oscillated along a circular arc 110 having the radius of curvature R, and at the outlet or discharge openings 5*d* of the mold 5 the guide tracks or paths 52 and 52' form tangents with such circular arc 110 along with the mold 5** is oscillated.

It is here mentioned that in the context of this disclosure the term "strand guide arrangement" is used in its broader sense to encompass not only strictly strand guide arrangements but also strand supporting and guide arrangements.

While there are shown and described present preferred embodiments of the invention, it is to be distinctly understood that the invention is not limited thereto, but may be otherwise variously embodied and practiced within the scope of the following claims. Accordingly,

What we claim is:

1. A method of continuously casting metal strands, especially steel strands, comprising the steps of:

introducing molten metal to be cast into an essentially horizontally extending, metallic continuous casting mold through a mold inlet opening at an upper wall of the metallic mold, said metal being introduced in a direction substantially normal to the longitudinal axes of the cast strands;

withdrawing two partially solidified strands from opposite lateral outlet openings of the continuous casting mold;

guiding each of the withdrawn cast strands along two strand guide tracks curved in opposite direction to a level which is lower than the level of the continuous casting mold;

cooling the thus withdrawn cast strands;

thereafter straightening the withdrawn cast strands;

employing as the continuous casting mold a curved continuous casting mold having a predetermined center of curvature; and said step of guiding each of the withdrawn cast strands includes guiding at least one of the withdrawn cast strands along its strand guide track such that at least a portion of said at least one withdrawn cast strand is curved so as to possess a predetermined center of curvature which is located on an opposite side of said withdrawn cast strand than the location of said predetermined center of curvature of said curved continuous casting mold.

2. The method as defined in claim 1, further including the step of:

guiding at least one of the cast strand along a substantially linear guide track after its having been guided along the first curved strand guide track.

3. The method as defined in claim 1, further including the step of:

guiding at least one of the strand along said two curved strand guide tracks which have respectively different radii of curvature.

4. The method as defined in claim 1, further including the step of:

guiding at least one of the strand along at least one of the two curved strand guide tracks which has a number of different radii of curvature.

5. A method for casting metal strands, especially steel strands, comprising the steps of:

introducing molten metal to be cast into an essentially horizontally extending, metallic continuous casting mold through a mold inlet opening provided at an upper mold wall;

employing as the continuous casting mold a curved continuous casting mold having a predetermined center of curvature;

withdrawing partially solidified cast strands from two oppositely situated lateral outlet openings of the continuous casting mold;

guiding the strands after their departure from the continuous casting mold along respective downwardly curved guide tracks without previously guiding the strands along upwardly curved guide tracks;

said step of guiding the strands includes guiding at least one of the withdrawn cast strands along its strand guide track such that at least a portion of said at least one withdrawn cast strand is curved so as to possess a predetermined center of curvature which is located on an opposite side of said withdrawn cast strand than the location of said predetermined center of curvature of said curved continuous casting mold;

cooling the withdrawn cast strands; and thereafter straightening the withdrawn cast strands.

6. The method as defined in claim 5, further including the step of:

passing at least one of the cast strands between the mold and its curved guide track along a substantially linear guide track.

7. The method as defined in claim 5 or 6, further including the step of:

guiding the strand along a curved guide track which possesses a plurality of different radii of curvature.

8. The method as defined in claim 5, wherein:

the strands are guided along said respective downwardly curved guide tracks directly after their departure from the continuous casting mold.

9. A method for casting metal strands, especially steel strands, comprising the steps of:

introducing molten metal to be cast into an essentially horizontally extending, metallic continuous casting mold through a mold inlet opening provided at an upper mold wall;

employing as the continuous casting mold a curved continuous casting mold having a predetermined center of curvature;

withdrawing partially solidified cast strands from two oppositely situated lateral outlet openings of the continuous casting mold;

guiding the strands immediately after their departure from the continuous casting mold along respective downwardly extending guide tracks;

said step of guiding the strands includes guiding at least one of the withdrawn cast strands along its strand guide track such that at least a portion of said at least one withdrawn cast strand is curved so as to possess a predetermined center of curvature which is located on an opposite side of said withdrawn cast strand than the location of said predetermined center of curvature of said curved continuous casting mold;

cooling the withdrawn cast strands; and thereafter straightening the withdrawn cast strands.

10. A continuous casting installation for the continuous casting of molten metal, especially steel, comprising:

an essentially horizontally extending continuous casting mold having an upper mold wall;

said upper mold wall being provided with a mold inlet opening for the infeed of the molten metal which is to be cast and at least one outlet opening for a cast strand;

a strand guide arrangement for at least one cast strand which laterally departs out of the continuous casting mold through said at least one outlet opening;

said strand guide arrangement for each related cast strand containing two strand guide tracks defining first and second guide tracks curved in opposite directions;

each of said two strand guide tracks having a predetermined radius of curvature and each radius of curvature having a center;

the center of the radius curvature of the first guide track, viewed in the direction of travel of the cast strand, being located below its related first guide track;

the center of the radius of curvature of the second guide track being located above its related second guide tracks;

said continuous casting mold comprises a curved continuous casting mold having a predetermined center of curvature; and the center of curvature of one of said two strand guide tracks being located on said side thereof which is opposite to the side of said one of said two strand guide tracks at which there is located said predetermined center of curvature of said continuous casting mold.

11. The continuous casting installation as defined in claim 10, further including:

a straightening unit for producing straight cast strands arranged immediately after the second guide track.

12. The continuous casting installation as defined in claim 10 or 11, further including:

a linear guide track arranged after the first guide track.

13. The continuous casting installation as defined in claim 10, wherein:

said first and second curved guide tracks possess mutually different radii of curvature.

14. The continuous casting installation as defined in claim 10, wherein:

at least one of the two strand guide tracks possesses a number of different radii of curvature.

15. The continuous casting installation as defined in claim 10, wherein:

said continuous casting mold has a curved hollow mold compartment;

the first guide track following the continuous casting mold possessing the same radius of curvature as said curved hollow mold compartment of the continuous casting mold.

16. A continuous casting installation for the continuous casting of molten metal, especially steel, comprising:

an essentially horizontally extending continuous casting mold having a curved hollow mold compartment and an upper mold wall;

said curved hollow mold compartment having a predetermined center of curvature;

said upper mold wall being provided with a mold inlet opening for the infeed of the molten metal which is to be cast and two oppositely situated outlet openings for the discharge of two cast strands withdrawn in opposite directions through said oppositely situated outlet openings;

a respective strand guide arrangement for each of the cast strands laterally departing through said two oppositely situated outlet openings from the continuous casting mold;

oscillation means for oscillating said continuous casting mold;

each of said strand guide arrangements containing a downwardly curved strand guide track located adjacent a related one of the outlet openings of the continuous casting mold;

the center of curvature of one of said downwardly curved guide tracks being located on a side thereof which is opposite to the side of said one of said two downwardly curved guide tracks at which there is located said predetermined center of curvature of said curved hollow mold comparatment; and a respective straightening machine disposed after each strand guide track for producing substantially straight strands.

17. The continuous casting installation as defined in claim 16, wherein:

said curved guide tracks are situated opposite one another at opposed sides of the continuous casting mold and possess different radii of curvature.

18. The continuous casting installation as defined in claim 16, wherein:

at least one of the curved guide tracks possesses a number of different radii of curvature.

* * * * *

UNITED STATES PATENT AND TRADEMARK OFFICE

CERTIFICATE OF CORRECTION

PATENT NO. : 4,566,526

DATED : 28 January 1986

INVENTOR(S) : Herbert FASTERT et al.

It is certified that error appears in the above-identified patent and that said Letters Patent is hereby corrected as shown below:

Foremost Page, Assignee: "Concast, Incorporated" should read --SMS CONCAST INC.--.

Signed and Sealed this

Nineteenth Day of December, 1989

*Attest:*

JEFFREY M. SAMUELS

*Attesting Officer* *Acting Commissioner of Patents and Trademarks*